United States Patent [19]

Mori

[11] Patent Number: 4,959,951

[45] Date of Patent: Oct. 2, 1990

[54] YARN GUIDE DEVICE FOR A TWO-FOR-ONE TWISTER

[75] Inventor: Shigeki Mori, Ohtsu, Japan

[73] Assignee: Murata Kikai Kabushiki Kaisha, Kyoto, Japan

[21] Appl. No.: 354,925

[22] Filed: May 22, 1989

[30] Foreign Application Priority Data

May 24, 1988 [JP] Japan ..... 63-12634

[51] Int. Cl.[5] ..... D01H 7/86; D01H 13/04

[52] U.S. Cl. ..... 57/58.52; 57/58.83; 57/58.86; 57/352

[58] Field of Search ..... 57/58.49, 58.52, 58.83, 57/58.86, 59, 352; 242/128

[56] References Cited

U.S. PATENT DOCUMENTS

| | | | |
|---|---|---|---|
| 1,995,533 | 3/1935 | Bochmann et al. | 57/58.52 |
| 3,177,643 | 4/1965 | DeHalleux et al. | 57/58.86 |
| 3,339,862 | 9/1967 | Parker | 242/128 |
| 3,726,075 | 4/1973 | Akachi | 57/59 |
| 3,742,693 | 7/1973 | Greive et al. | 57/58.52 X |
| 3,763,899 | 10/1973 | Orlandi | 57/59 X |
| 3,783,597 | 1/1974 | Greive et al. | 57/58.52 |
| 3,791,119 | 2/1974 | Godderidge | 57/59 X |
| 3,807,156 | 4/1974 | Gre | 57/58.52 |
| 4,641,493 | 2/1987 | Fukunaga | 57/58.83 X |
| 4,782,653 | 11/1988 | Yanobu | 57/58.83 X |

*Primary Examiner*—John Petrakes

*Attorney, Agent, or Firm*—Spensley Horn Jubas & Lubitz

[57] ABSTRACT

A yarn guide device for a two-for-one twister comprises a guide pipe disposed upright above yarn packages placed on a spindle, which guides yarns unwound from the yarn packages into the bore of the packages from above the same, and a freely rotatable ring member provided on the guide pipe to be contacted with the yarns and to bend slightly a yarn path at the peripheral end thereof. The ring member is rotated by the yarns released from the package in a direction of releasing of the yarns.

8 Claims, 4 Drawing Sheets

YARN GUIDE DEVICE FOR A TWO-FOR-ONE TWISTER

FIELD OF THE INVENTION

The present invention relates to a yarn guide device for a two-for-one twister which unwinds yarns simultaneously from two yarn packages, doubles the yarns and twists the yarns.

RELATED ART SYSTEM

There has been known a method of doubling and twisting two yarns on a two-for-one twister. This method has a significant advantage that two yarns unwound from two yarn packages supported one over the other on a spindle can be simultaneously doubled and twisted. However, this method causes a great difference in tension between the yarns unwound from the two yarn packages because the yarn unwound from the lower yarn package runs upward in sliding contact with the circumference of the upper yarn package and is obliged to run against a frictional resistance; consequently, it often occurs that the yarn unwound from the lower yarn package is broken or the yarns are twisted faultily with the loose yarn unwound from the upper yarn package coiled helically around the tense yarn unwound from the lower yarn package. Principal cause of increase in the tension of the yarn unwound from the lower yarn package is the frictional resistance of the circumference of the upper yarn package against the movement of the yarn unwound from the lower yarn package and running in frictional sliding contact with the circumference of the upper yarn package. Means have been proposed to suppress increase in the tension of the yarn unwound from the lower yarn package relative to that of the tension of the yarn unwound from the upper yarn package by providing a guide disk between the upper and lower yarn packages or by using a lower yarn package having a comparatively large diameter and an upper yarn package having a comparatively small diameter to reduce the contact pressure of the yarn unwound from the lower yarn package on the circumference of the upper yarn package. However, neither is very effective. The former means is unable to reduce the tension of the yarn unwound from the lower yarn package, rather increases the tension because the guide disk forms additional bends in the running path of the yarn. The latter means has an inconvenience that the upper yarn package is exhausted before the lower yarn package is exhausted. In employing the latter means, it is possible to make the upper and lower yarn packages to be exhausted simultaneously by increasing the package width, namely, the width of yarn layers, of the yarn package relative to that of the lower yarn package so that the amount of yarn wound on the upper yarn package is the same as that of the yarn wound on the lower yarn package, which, however, requires automatic winders respectively having different winding widths (the stroke of traverse motion) for preparing yarn packages having different package widths. Thus, two-for-one twister is unavoidably obliged to twist yarns unwound from two yarn packages of the same size.

The inventor of the present invention made experiments to find effective means for satisfactorily reducing the tension of the yarn unwound from two yarn packages placed one over the other on a spindle of a two-for-one twister and has found the following facts.

In a conventional yarn guide device, a guide pipe for guiding yarns unwound from upper and lower yarn packages through the upper end of a spindle into the bore of the same is disposed upright coaxially with the spindle. In this spindle, the yarns are pressed at a comparatively high contact pressure against the circumference of the upper yarn package because the yarns run along a straight yarn path extending between the upper shoulder of the upper yarn package and the upper inlet of the guide pipe at a small angle to the upper end surface of the upper yarn package. It was found that the contact pressure can be reduced by changing a portion of the yarn path after the upper shoulder of the upper yarn package and the present invention has been made on the basis of the foregoing finding.

OBJECT AND SUMMARY OF THE INVENTION

It is an object of the present invention to provide a yarn guide device for a two-for-one twister, capable of reducing the possibility of yarn breakage and faulty twisting in doubling and twisting yarns by the two-for-one twister.

In one aspect of the present invention, a yarn guide device for a two-for-one twister comprises a guide pipe disposed upright above yarn packages placed on a spindle, which guides yarns unwound from the yarn packages into the bore of the packages from above the same, and a freely rotatable ring member provided on the guide pipe to be contacted with the yarns and to bend slightly a yarn path at the peripheral end thereof, said ring member being rotated by the yarns released from the package in a direction of releasing of the yarns.

When applied to a two-for-one twister for dubling and twisting yarns unwound from two yarn packages disposed on over the other on a spindle, the yarn guide device of the present invention enables the two yarns to be tensioned at the substantially the same level, so that yarn breakage and faultily twisted portions in the twisted yarn are reduced to the least extent.

DETAILED DESCRIPTION OF PREFERRED EMBODIMENTS

Figure 1:
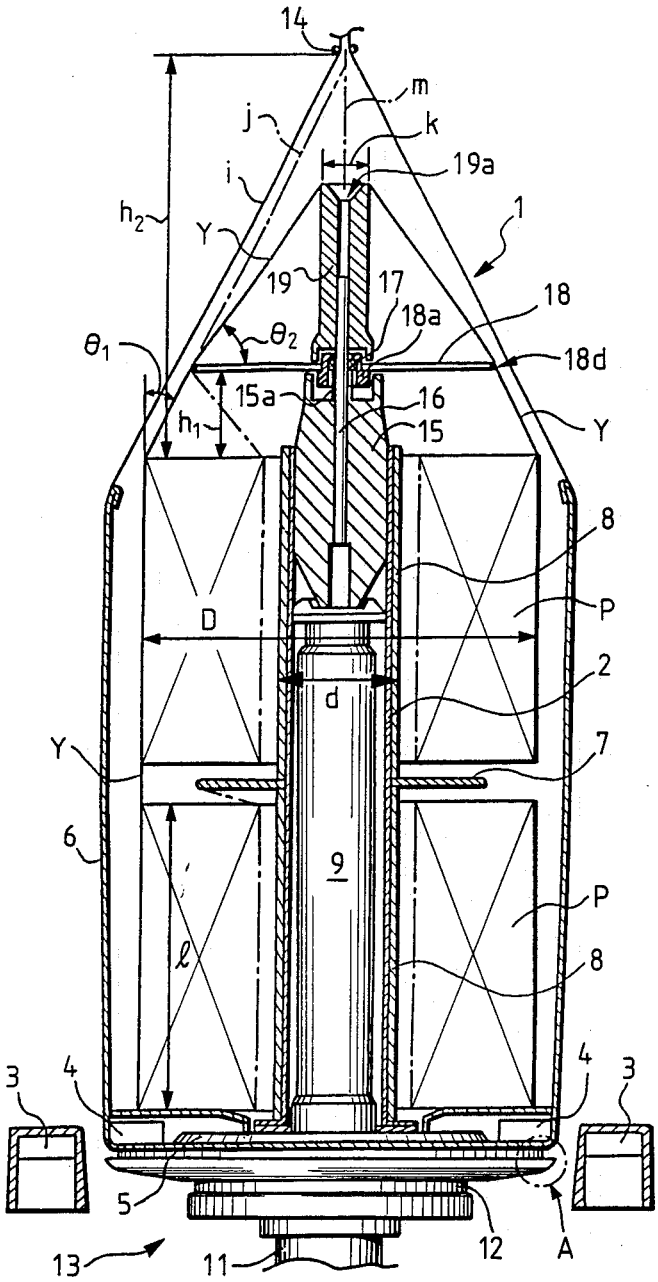
FIG. 1 is a longitudinal sectional view of a two-for-one twister employing a yarn guide device embodying the present invention.

Referring to FIG. 1 showing a two-for-one twister equipped with a yarn guide device 1 embodying the present invention in a longitudinal sectional view, a stationary disk 5 is held stationary by the attraction between external magnets 3 and magnets 4 attached to peripheral portion of the stationary disk 5, a package support tube 2 is set upright on the stationary disk 5, a package cover 6 is formed integrally with the stationary disk 5, and two yarn packages P are put on the package support tube 2 one over the other with a guide disk 7 therebetween. Indicated at 8 are take-up tubes on which yarns are wound to form the yarn packages P, and at 9 is a guide tube set upright on the central portion of the stationary disk 5 and internally provided with a tension device, not shown. The yarn unwound from the yarn packages P pass vertically downward through the bore of the guide tube 9. A spindle 13 consists of a spindle wharve 11 which is brought into rolling contact with a driving belt, not shown, for rotation, and a yarn storage disk 12. The yarns passed through the bore of the guide tube 9 is drawn out laterally through a hole formed in the circumference of the yarn storage disk 12.

A guide ring 14 guides the yarns running upward in a balloon after leaving the yarn storage disk 12. The yarn guide device 1 is disposed above the guide tube 9 and is put coaxially on the package support tube 2.

The yarn guide device 1 comprises a tubular base member 15 having a diameter substantially the same as the inside diameter of the package support tube 2 and having a lower portion fitted in the bore of the package support tube 2, a threading pipe 16 coaxially penetrating the tubular base member 15, a ring member 18 rotatably supported by a miniature ball bearing 17 on the threading pipe 16 at a position near the upper end of the tubular base member 15, and a guide pipe 19 coaxially put on the upper portion of threading pipe 16 projecting upward beyond the ring member 18.

Figure 2:
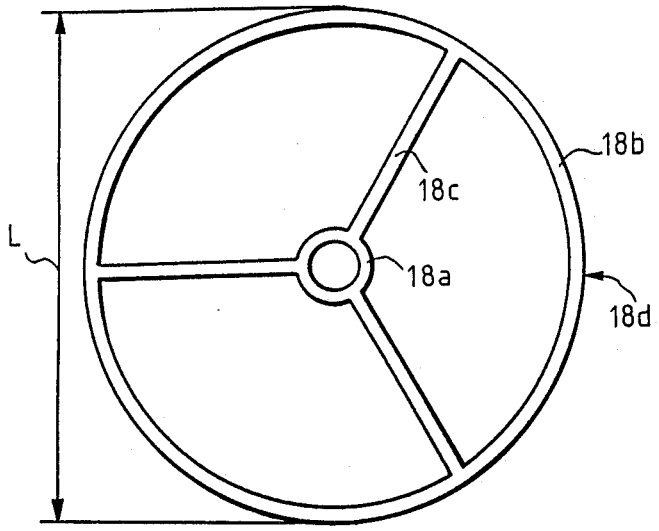
FIG. 2 is a plan view of a guide ring.

As shown in FIG. 2 in a plan view, the ring member 18 consists of a hub **18*a* having an inside diameter slightly greater than the outside diameter of the threading pipe 16, a rim 18*b* and three spokes 18*c* interconnecting the hub 18*a* and the rim 18*b*. The ring member 18 is formed of a synthetic resin in an integral construction having a very small weight (in this embodiment, 15 g). The miniature ball bearing 17 is fitted in the boss 18*a* to support the ring member 18 on the threading pipe 16** for very light rotation.

The inner race, not shown, of the miniature ball bearing 17 is seated on the upper end of the inner boss **15*a* formed at the upper end of the tubular base member 15 to position the ring member 18 relative to the threading pipe 16**.

The outer circumference **18*d* of the rim 18*b* is finished in a very smooth surface so that yarns Y running in sliding contact with the outer circumference 18*d* will not be tensioned by the frictional resistance of the outer circumference 18*d*. The outside diameter L of the rim 18*b*** is determined so as to meet the following conditions.

The outside diameter L coincide substantially with the diameter of the yarn package P at the middle of an interval between the start of unwinding the yarn package P and the exhaustion of the yarn package P.

That is, since $$\rho \cdot l \frac{\pi(D^2 - d^2)}{4} \times \tfrac{1}{2} = \rho \cdot l \frac{\pi(X^2 - d^2)}{4}$$

therefore, $$X = \sqrt{\frac{(D^2 + d^2)}{2}}$$

where D is the outside diameter of a full yarn package, d is the outside diameter of a take up tube 8, $\rho$ is the density of the yarn layers of the yarn package, l is the package width of the yarn package, and X is the outside diameter of the yarn package at the middle of an interval between the start of unwinding the yarn from the full yarn package and the exhaustion of the yarn package. The outside diameter L of the guide rim **18*b*** is substantially equal to the outside diameter X.

In this embodiment, D is 170 mm, d is 49 mm, X is approximately 125 mm, and L is 130 mm.

The ring member 18 is positioned at a maximum height from the upper end surface of the upper yarn package P below which the ring member 18 will not touch the yarn extending in a balloon between the package cover 6 and the guide ring 14.

That is, the ring member 18 is positioned at a maximum height $h_1$ from the upper end surface of the upper yarn package P below which the ring member 18 does not touch a line i (FIG. 1) extending between the upper end of the package cover 6 and the guide ring 14. In this embodiment, the maximum height $h_1$ is 35 mm, and the height $h_2$ of the guide ring 14 from the upper end surface of the upper yarn package P is 210 mm.

The height of the upper end of the guide pipe 19 from the upper end surface of the upper yarn package P. and the outside diameter k of the upper end of the guide pipe 19 are determined so as to meet the following conditions.

If the outside diameter k is excessively large, the angular delay of the yarns on the edge of the upper end of the guide pipe 19 is large, and thereby the tension of the yarns is increased. Accordingly, it is desirable that the outside diameter of the upper end of the guide pipe 19 is as small as possible. In this embodiment, the outside diameter of the upper end of the guide pipe 19 is 20 mm. The height of the upper end of the guide pipe 19 from the upper end surface of the upper yarn package P is determined so that the upper end of the guide pipe 19 is positioned at a maximum height below the intersection of an alternate long and short dash line j interconnecting the outer circumference **18*d* of the ring member 18 positioned at the maximum height meeting the foregoing conditions and the upper shoulder of the upper yarn package P when the same is full, and the center axis of the guide pipe 19, and so that the yarn Y unwound from the yarn package P and running into the bore 19*a* of the guide pipe 19 touches the outer circumference 18*d* of the ring member 18** so as to be bent slightly when the upper yarn package P is full.

As is obvious from the foregoing description, the outside diameter and height of the ring member 18 are determined so that the mean of the variable angle $\theta_1$ of the yarns being unwound from the yarn packages P to a line parallel to the vertical generating line of the side face of the yarn packages P with respect to time is a minimum. That is, an integral value $\int \theta(t)dt$ with respect to the time from start of unwinding of a package having an angle 8 to termination of unwinding is set to be minimum. The height of the upper end of the guide pipe 19 is determined so that the angle $\theta_2$ of the yarns extending between the outer circumference **18*a* of the ring member 18 and the upper end of the guide pipe 19 to a plane including the ring member 18** is a maximum.

The height of the guide ring 14 from the upper end surface of the upper yarn package is determined at a minimum above which a balloon formed by the yarns turning around the package cover 6 is allowed to expand so that the yarns will not touch any part of the package cover 6. The smaller the height of the guide ring 14, the less is energy consumed by the balloon, hence less is power consumption.

Functions of this embodiment will be described hereinafter.

The yarns unwound from the two yarn packages P disposed one over the other depart from the upper shoulder of the upper yarn package P and run in light contact with the circumference 18*d* of the guide ring 18 into the bore 19*a* of the guide pipe 19. The yarns are threaded downward through the guide pipe 19, the threading pipe 16 and the guide tube 9 in that order, and then the yarns are drawn out from the spindle 13. Then, the yarn runs upward in a balloon toward the guide ring 14. As mentioned above, the angle $\theta_1$ of contact of the yarns with the circumference 18*d* of the ring member 18 is comparatively small over the entire period of unwinding the yarns from the yarn packages P, and hence the pressure of contact of the yarns with the ring member 18 is comparatively small. Although the pressure of contact of the yarns with the ring member 18 is very small, the ring member 18 is dragged for rotation in the yarn unwinding direction by the running yarns, since the ring member 18 is capable of being rotated by a very small force. Thus, the frictional resistance of the circumference 18*d* against the sliding movement of the running yarns Y along the circumference 18*d* is reduced, and thereby the tension of the yarns Y is reduced.

When the amount of yarn of the yarn packages P decreases to a minimum, the yarns Y is drawn out along a path indicated by alternate long and short dash line in FIG. 1.

In the embodiment illustrated in FIG. 1, the guide disk 7 provided between the upper and lower yarn packages P may be replaced with a lightly rotatable member similar to the ring member 18, or may be omitted to place the upper yarn package P directly on top of the lower yarn package P.

Figure 6:
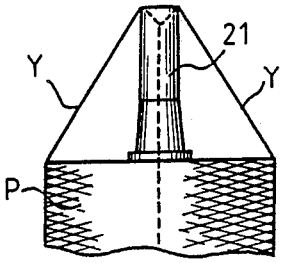
FIG. 6 PRIOR ART
FIG. 6 is a fragmentary side elecation of an essential portion of a conventional yarn guide device.

Results of experimental doubling and twisting operation using the yarn guide device of the present invention and a conventional yarn guide device as shown in FIG. 6 will be described hereinafter. The conventional yarn guide device is not provided with any rotary ring member; the same comprises only a guide pipe 21.

Figure 3:
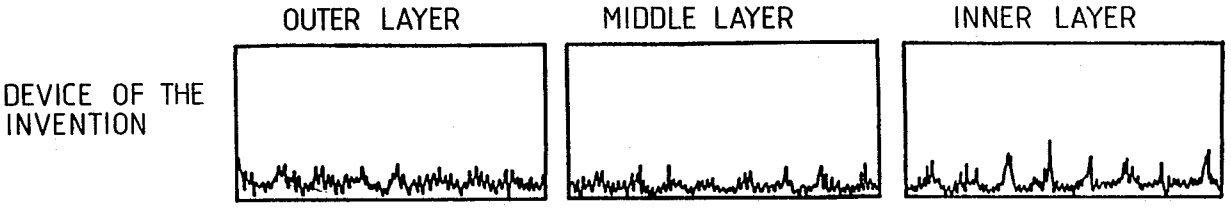
FIGS. 3 and 4 are graphs showing modes of variation of tension of yarns guided respectively by the yarn guide device of the present invention and the conventional yarn guide device.
Figure 4:
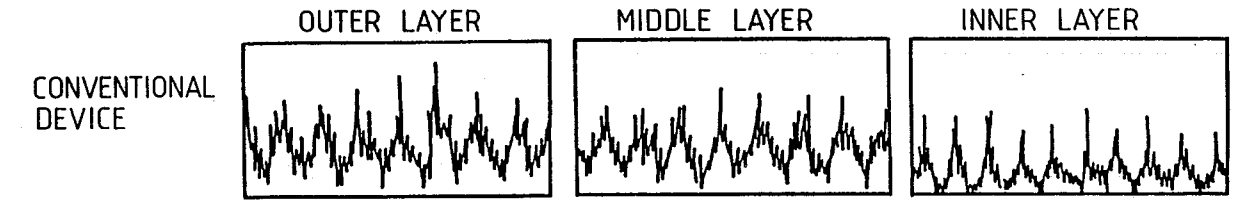

FIGS. 3 and 4 are graphs respectively showing modes of variation of the tension of yarns guided respectively by the yarn guide device of the present invention and the conventional yarn guide device, in which "outer layer" means the outermost surface layer of a full yarn package, namely, the surface layer at the start of unwinding a full yarn package, "middle layer" means the middle layer of the full yarn package, and "inner layer" means the innermost layer of the full yarn package, namely, the surface layer near the end of unwinding the yarn package.

As is obvious from FIGS. 3 and 4, the amplitude of the tension variation curve and values of the tension for the yarn guide device of the present invention are smaller than those for the conventional yarn guide device.

In measuring the tension, the spindle was held stationary, the yarn was threaded along the threading path, and the tension of the running yarn was measured by a tension sensor fixedly positioned near a position A (FIG. 1).

Figure 5:
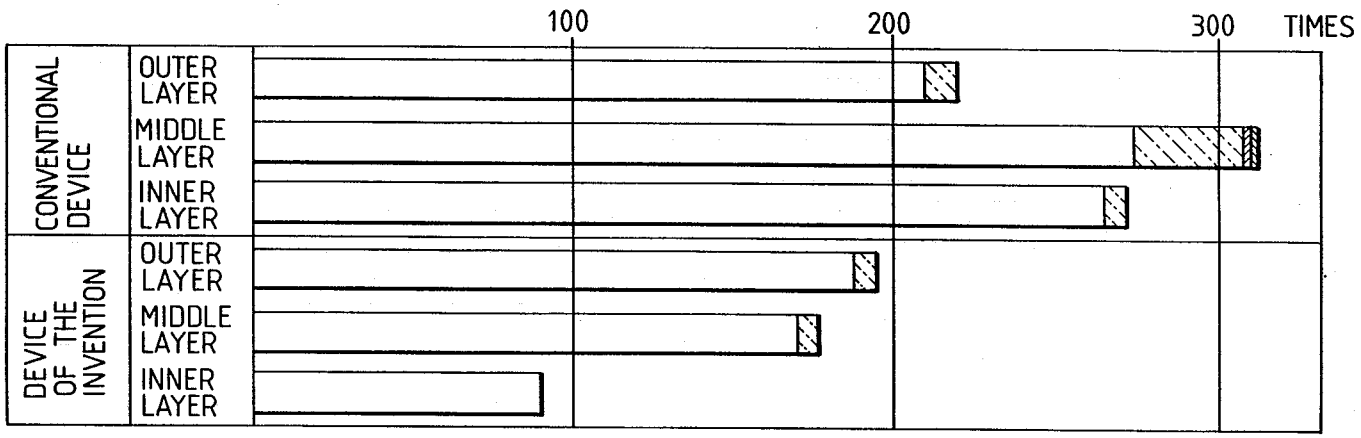
FIG. 5 is a graph showing the frequency of abnormal tension.

FIG. 5 is a bar graph showing frequencies of abnormal ballooning tension values (300 g and above) in twenty minutes when measured at a position slightly above the guide ring 14 (FIG. 1) during the doubling and twisting operation. The meaning of "outer layer", "middle layer" and "inner layer" is the same as that of FIGS. 3 and 4.

In FIG. 5, blank portions of bars represent frequencies of tension exceeding 300 g, portions hatched by alternate long and short dash lines represent frequencies of tension exceeding 350 g, portions hatched by oblique lines declining to the left are frequencies of tension exceeding 400 g and portions hatched by oblique lines declining to the right are frequencies of tension exceeding 500 g.

In the experimental doubling and twisting operation for FIG. 5, the yarn count of the yarns was Nm 2/37 (two yarns of Nm 37), the rotating speed of the spindle was 9000 rpm, and the inserted twist was 260 T/M.

The frequency of yarn breakage was measured while a two-for-one twister having 120 spindles was operated under operating conditions substantially the same as those stated above. The frequency of yarn breakage in the doubling and twisting operation was 8.5 times for the conventional yarn guide device and zero times for the yarn guide device of the present invention.

As is apparent from the foregoing description, the yarn guide device of the present invention reduces the tension of the yarn unwound from a yarn package significantly and reduces the frequency of yarn breakage to the least extent.

What is claimed is:

1. In a two-for-one twister operable to unwind yarn from first and second yarn packages supported on a spindle provided with a spindle bore, the yarn packages each having an outside diameter, a yarn guide comprising:

a guide pipe for guiding yarns unwound from the yarn packages into the spindle bore, the guide pipe having an opening for receiving yarns unwound from the yarn packages;

rotatably supported ring member disposed above the yarn packages between the opening of the guide pipe and an upper end face of the first package, the ring member having an outside diameter which is less than the outside diameter of the first and second yarn packages before the unwinding operation is performed on the packages, wherein the yarns unwound from the yarn packages run in sliding contact with the outer circumference of the ring member and are guided into the bore of the spindle.

2. A yarn guide device according to claim 1, wherein the ring member has a surface which abuts yarns being unwound from the yarn packages and running into the bore of the spindle and receives a frictional force from such yarns to rotate the ring member.

3. A yarn guide device for a two-for-one twister which twists yarns unwound from two yarn packages supported one over the other on a spindle, the yarns extending vertically in a first direction through the bore of the packages and in a second direction in a balloon along the outer circumference of the packages, said yarn guide device comprising, a guide pipe disposed adjacent and substantially coaxially with the spindle to guide the yarns unwound from the yarn packages into the bore of the package; and a rotatable ring member supported by the guide pipe and having a peripheral surface disposed in contact with yarns unwound from the yarn package to guide the yarns into the opening of the guide pipe, the peripheral surface of the ring member defining a diameter of the ring member which is less than the outer diameter of the yarn packages prior to unwinding yarn from the yarn packages.

4. For a two-for-one twister having a stationary disk and operable to unwind yarn packages, a yarn guide device operable with a package support tube provided upright on the stationary disk for supporting two yarn packages, one above the other, the yarn guide device comprising:

a tubular base member having a diameter substantially the same as the inside diameter of the package support tube and having a lower portion fitted in the bore of the package support tube and an upper end extended from the package support tube, a threading pipe coaxially penetrating the tubular base member, a ring member rotatably supported by bearings on the threading pipe at a position near the upper end of the tubular base member, the ring member having an outer peripheral surface for abutting yarn extending from the yarn packages, the outer peripheral surface defining a diameter of the ring member which is less than the outer diameter of the yarn packages prior to unwinding yarn from the yarn packages, and a guide pipe coaxially disposed on the upper portion of the threading pipe and projecting upward beyond the ring member.

5. The yarn guide device according to claim 4, wherein said ring member comprises of a hub having an inside diameter slightly greater than the outside diameter of the threading pipe, a rim and a plurality of spokes interconnecting the hub and the rim.

6. The yarn guide device according to claim 5, wherein said ring member is formed of a synthetic resin having a very small weight.

7. The yarn guide device according to claim 4, wherein the outer diameter of the ring member substantially coincides with the diameter of each yarn package at the middle of an interval between the start of unwinding the yarn package and the exhaustion of the yarn package.

8. The yarn device according to claim 7, wherein yarn unwound from each yarn package extends in a balloon adjacent the yarn guide device, and wherein said ring member is positioned at a maximum height from the upper surface of the upper yarn package below which the ring member does not touch the yarn extending in a balloon.

* * * * *